US007331291B2

(12) United States Patent
Kang

(10) Patent No.: US 7,331,291 B2
(45) Date of Patent: Feb. 19, 2008

(54) SELF-SUPPORTING AIR TUBE FOR BLASTING

(76) Inventor: Dae Woo Kang, 216-1702 Shingaegum LG Apt., 455 Gaegum-dong, Busanjin-gu, Busan 614-751 (KR)

( * ) Notice: Subject to any disclaimer, the term of this patent is extended or adjusted under 35 U.S.C. 154(b) by 0 days.

(21) Appl. No.: 11/131,670

(22) Filed: May 17, 2005

(65) Prior Publication Data

US 2006/0201370 A1 Sep. 14, 2006

(30) Foreign Application Priority Data

Mar. 11, 2005 (KR) ..... 10-2005-0020515

(51) Int. Cl.
*F42D 5/00* (2006.01)

(52) U.S. Cl. ..... 102/303; 102/311; 102/312

(58) Field of Classification Search ..... 102/311, 102/312, 313, 303, 333
See application file for complete search history.

(56) References Cited

U.S. PATENT DOCUMENTS

| | | | |
|---|---|---|---|
| 2,703,528 | A | 3/1955 | Lee et al. |
| 2,858,764 | A | 11/1958 | Hesson et al. |
| 2,920,523 | A | 1/1960 | Barco et al. |
| 3,134,437 | A | 5/1964 | Karpovich |
| 3,954,058 | A | 5/1976 | Sanders et al. |
| 4,382,410 | A | 5/1983 | Bowling et al. |
| 4,419,935 | A | 12/1983 | Shibukawa |
| 4,438,699 | A | 3/1984 | Nitzberg |
| 4,572,075 | A | 2/1986 | Day et al. |
| 4,674,532 | A | 6/1987 | Koyanagi |
| 4,736,796 | A | 4/1988 | Arnall et al. |
| 4,813,358 | A | 3/1989 | Roberts |

(Continued)

FOREIGN PATENT DOCUMENTS

| | | |
|---|---|---|
| GB | 2080856 | 2/1982 |

(Continued)

OTHER PUBLICATIONS

Advertising for Vari-Stem of St. Louis, Missouri for "Greater Rock Fragmentation, Less Cost"; *The Journal of Explosives Engineering*, ISEE Drilling Section, Jul./Aug. 1999, p. 22.

(Continued)

*Primary Examiner*—Michael J. Carone
*Assistant Examiner*—Gabriel J Klein
(74) *Attorney, Agent, or Firm*—Sheridan Ross P.C.

(57) ABSTRACT

A self-supporting air tube for blasting and method of blasting rock using the air tube. The air tube includes an air bladder, a pair of support wings and an inlet. The air bladder has a diameter smaller than that of a blasting hole and extends longitudinally. The support wings extend from the outside of the air bladder to the wall of the blasting hole symmetrically with respect to the longitudinal axis of the air bladder so as to surround the air bladder and have certain widths. The inlet is attached to the upper fusion-welded portion of the air bladder to inject air into the air bladder. The total diameter of the air tube is smaller than the diameter of the blasting hole, and the air tube is inserted into the blasting hole and self-supported on a wall of the blasting hole.

5 Claims, 18 Drawing Sheets

U.S. PATENT DOCUMENTS

| | | | |
|---|---|---|---|
| 4,913,233 | A | 4/1990 | Fitzgibbon, Jr. |
| 4,919,203 | A | 4/1990 | Fitzgibbon, Jr. |
| 5,000,261 | A | 3/1991 | Fitzgibbon, Jr. |
| 5,035,286 | A | 7/1991 | Fitzgibbon, Jr. |
| 5,259,316 | A | 11/1993 | Nelson et al. |
| 5,273,110 | A | 12/1993 | Fitzgibbon, Jr. |
| 5,551,344 | A | 9/1996 | Couet et al. |
| 5,634,691 | A | 6/1997 | Kim et al. |
| 5,803,172 | A | 9/1998 | Rajkovich |
| 5,841,060 | A | 11/1998 | Skaggs |
| 5,900,578 | A | 5/1999 | Wathen |
| 5,936,187 | A | 8/1999 | Miller et al. |
| 6,165,297 | A | 12/2000 | Smith et al. |
| 6,209,458 | B1 | 4/2001 | Thomson et al. |
| 6,213,212 | B1 | 4/2001 | Jenkins, Jr. et al. |
| 6,330,860 | B1 | 12/2001 | Kang |
| 6,386,111 | B1 | 5/2002 | Shann |
| 6,454,359 | B1 | 9/2002 | Kang |
| 6,631,684 | B2 | 10/2003 | Kang |

FOREIGN PATENT DOCUMENTS

| | | |
|---|---|---|
| JP | 06129800 | 5/1994 |
| JP | 06323797 | 11/1994 |

OTHER PUBLICATIONS

Liu et al.; "Numerical Modeling of the Effects of Air Decking/Decoupling in Production and Controlled Blasting"; *Rock Fragmentation by Blasting*, Mohanty (Ed.) ISBN 90 5410 824X; pp. 319-330.

Yang et al.; "Ground Vibration from single-Hole Cast Blasts"; *The Journal of Explosives Engineering*, Mar./Apr. 1999, pp. 37-41.

- PRIOR ART -

- PRIOR ART -

SELF-SUPPORTING AIR TUBE FOR BLASTING

BACKGROUND OF THE INVENTION

1. Field of the Invention

The present invention relates, in general, to a self-supporting air tube for blasting and method of blasting rock using the air tube and, more particularly, to a self-supporting air tube for blasting and method of blasting rock using the air tube that allow a pair of support wings, extending from the outside of an air bladder to the wall of the blasting hole symmetrically with respect to the longitudinal axis of the air bladder, to be supported on the wall of a blasting hole and, therefore, positions the air bladder in the center portion of the blasting hole, so that explosive loaded in the blasting hole can be uniformly distributed throughout the blasting hole, thus performing an air decking function and uniformly projecting explosive power onto the rock, and that allow weights to be accommodated in weight pockets formed below the support wings or in the lower portions of the support wings, so that the center of gravity of the air tube can be positioned at the lower portion of the air tube and, therefore, the easy insertion of the air tube into the blasting hole and the quick installation of the air tube in the blasting hole can be achieved, thus considerably shortening blasting time.

2. Description of the Related Art

In the field of rock blasting, air decking is a technology of exploding explosive while maintaining a space, which functions as a small free face, in a drilled blasting hole, thus reducing the amount of explosive used and decreasing vibration and noise generated at the time of blasting.

A representative air decking technology prevents explosive power from leaking via a blasting hole at the time of blasting by placing a plug between stemming material and explosive, as disclosed in U.S. Pat. No. 5,936,187. The plug is made of soft material, has a cap shape with stripe-shaped grooves, is inserted into a blasting hole and forms an air layer. With the representative air decking technology, the number of flying rocks and blasting noise are reduced and the degree of breakage is increased.

The technology is a technology of preventing the explosion power of explosive from leaking via blasting holes, so that the technology is disadvantageous in that it does not form air layers in blasting holes, and does not control the length of loaded explosive and expand the area onto which explosive power is projected through forming air layers.

Furthermore, in the technology, the plug may become stuck in the middle of a blasting hole at the time of fitting the plug into the blasting hole, so that it becomes technically impossible to control the amount of air in the blasting hole. The reason for this is that it is impossible to maintain a uniform drilling diameter due to the wear of the drill bit caused by the friction between the drill bit and rock.

Another decking technology is a blasting method using gasbags, which is disclosed in U.S. Pat. No. 6,213,212. The gasbag used in this technology is manufactured by separately inserting powder and liquid into the same tube so that the powder and the liquid can be easily mixed with each other at a blasting site. When the gasbag is inserted into a blasting hole at a certain location, the powder reacts with the liquid after two or three hours, so that the gasbag inflates and comes into tight contact with the wall of the blasting hole, thus forming an air layer.

However, the second air decking technology is problematic in that there are many cases where the powder and the liquid chemical component do not form the air layer even after 2 or 3 hours have elapsed. As a result the technology is disadvantageous in that the benefits of air decking are not realized in those cases and the cost thereof is high.

Still another technology is a technology of forming an air layer in a space surrounding a stake by placing a device, which is formed by resting a cap-shaped plastic plug on the stake, in the lower portion of a blasting hole or between explosives.

In order to solve the above-described problems of the conventional air decking technology, the present inventor proposed a method of blasting rock using air tubes embedded in a loaded explosive layer, in which, as shown in FIG. 1, artificial free faces are formed by inserting two or more air tubes 2 having a uniform length in a blasting hole 1, the air tubes 2 are embedded by surrounding the air tubes 2 with explosive and, thereafter, the explosive is exploded, in Preceding Korean Pat. No 10-0441222 (corresponding to U.S. Pat. No. 6,631,684, the contents of which is incorporated herein by reference it its entirety).

Unlike the existing air decking technologies, the above-described technology is a method in which air tubes, which are provided with air inlets to inject air into the air tubes and, therefore, prevent the leakage of the air and which are made of material capable of sufficiently withstanding the weight of explosive, are inserted into a blasting hole, explosive is loaded around the air tubes, and, finally, the explosive is exploded with the air tubes embedded in the explosive.

In accordance with the above-described technology, air tubes can be freely placed in the upper portion of a blasting hole, the lower portion of the blasting hole or between explosives, the amount of air can be appropriately adjusted depending on the strength of the rock, and the degree of breakage of rock can be controlled.

Furthermore, the projection area on rock near a free face is maximally increased by increasing the length of loaded explosive using the embedded type air tubes, so that the specific surface area to which explosive power is applied is enlarged and the explosive power of the explosive is used only to break the rock.

Furthermore, the length of explosion of explosive is increased due to increase in the specific surface area, so that total pressure is maximally increased in a blasting hole and rock is broken by the increased total pressure. The explosive is exploded near a free face, so that rock can be blasted using a small amount of explosive, and explosive power is distributed toward the free surface, thus reducing blasting vibration.

In the meantime, the length of a stemming material can be shortened due to the increased length of explosion of explosive, so that the occurrence of boulders can be considerably reduced.

However, in the rock blasting method using a conventional air tube embedded in a loaded explosive layer, the cases where an air tube having a diameter smaller than that of a blasting hole is inclined in the blasting hole or a lightweight air tube becomes stuck in the middle of a blasting hole occasionally occur. As a result, explosive cannot be uniformly distributed throughout the entire length of the blasting hole, so that the balance of explosive power applied to rock at the time of explosion is not kept, thus causing the occurrence of boulders.

Furthermore, to prevent an air tube from being inclined, a support frame 3 is fitted around the outside of an air tube 2 and the air tube 2 and the support frame 3 are inserted into a blasting hole, as shown in FIG. 2. Accordingly, the blasting method using the conventional air tube is disadvantageous in that installation work is inconvenient, blasting cost is increased and blasting time is lengthened.

Therefore, the present inventor proposes a self-supporting air tube for blasting and method for blasting rock using the air tube, in which the structure of the air tube is improved in such a way that a pair of support wings projecting from the outside of an air bladder symmetrically with respect to the longitudinal axis of the air bladder are integrated with the air bladder and one or more weight pockets can be attached to the lower portion of the air tube. As a result, the support wings are supported on the wall of a blasting hole and allow the air bladder to be positioned in the middle of the blasting hole, so that explosive blasts rock while being uniformly distributed throughout the blasting hole. The center of gravity of the air tube is positioned at the lower portion of the air tube due to the weight pockets attached to the lower portion of the air tube, so that the installation of the air tube in the blasting hole is facilitated and the quick installation of the air tube can be achieved, thus shortening blasting time.

That is, unlike a conventional technology in which an air tube is inclined at the time of installing the air tube in a blasting hole or in which an air tube is installed in a blasting hole using support equipment, the present invention utilizes a self-supporting air tube that is provided with a pair of support wings at the outside of an air bladder symmetrically with respect to the longitudinal axis of the air bladder, so that the air bladder is uniformly spaced apart from the wall of a blasting hole and positioned at the center of the blasting hole and the center of gravity of the air tube is positioned at the lower portion of the air tube. Accordingly, the air tube can be quickly and easily installed in a blasting hole, the explosive power of explosive is maximally distributed throughout the blasting hole due to the air tube forming an artificial free face, and the explosive power of explosive is uniformly projected onto rock at the time of explosion.

According to the above characteristics, the self-supporting tube is embedded in explosive, so that the amount of use of explosive is reduced, explosion vibration can be distributed toward an internal artificial free face, and the length of explosion of explosive can be extended up to the free face, thus considerably reducing the occurrence of boulders.

In general, general rock blasting on an open field is associated with two or three free faces, so that two or three free faces are achieved in proportion with the height of a step. Accordingly, rock can be broken in proportion to the increase in the number of free faces even though explosive power is weaker. In the case of a general rock blasting method, the explosive power of explosive is not sufficiently transmitted to rock due to a large stemming length.

However, in the method of the present invention, an air tube is embedded in explosive, so that the amount of loaded explosive can be minimized and the length of explosion of explosive can be maximized. The explosive can be loaded in the vicinity of two or three free faces with the help of the self-supporting air tubes, so that vibration is considerably reduced and the degree of breakage of rock can be considerably increased.

Meanwhile, since the drill of a drilling machine is repeatedly used at the time of drilling a blasting hole to use ANFO or Bulk type watergel explosive, there occurs a bit gage drop phenomenon in which the front part of the drill is worn away and the diameter of a drilled hole is reduced.

As a result, the amounts of loaded ANFO or Bulk type watergel explosive composed of powder are different for individual blasting holes due to the different diameters of drilled holes, so that it is technically difficult to adjust the amount of ANFO or Bulk type watergel explosive. The present invention is a scheme capable of overcoming the difference in stemming length by adjusting the length of the air tube.

It should be understood that the term "self-supporting" used in the present specification and the attached claims refers to "standing upright and being supported in a blasting hole without using special equipment" in the case of inserting an air tube into the blasting hole.

SUMMARY OF THE INVENTION

Accordingly, the present invention has been made keeping in mind the above problems occurring in the prior art, and an object of the present invention is to provide a self-supporting air tube for blasting and method of blasting rock using the air tube, in which a pair of support wings are formed by extending outward from the outside of an air bladder to the wall of the blasting hole symmetrically with respect to a longitudinal axis of the air bladder, so that the air tube is positioned in the center portion of a blasting hole while being spaced from the wall of the blasting hole by a uniform distance and is surrounded by explosive, thus performing an air decking function at the time of explosion and uniformly applying explosive power to rock around the blasting hole.

Another object of the present invention is to provide a self-supporting air tube for blasting and method of blasting rock using the air tube, which allow weights to be inserted and suspended below an air bladder, so that the air tube can be easily and quickly inserted into a blasting hole, thus considerably shortening blasting time.

A further object of the present invention is to provide a self-supporting air tube for blasting and method of blasting rock using the air tube, which enable the amount of use of ANFO or Bulk type watergel explosive and a stemming length to be adjusted even though the diameter of a drilled hole varies.

Yet another object of the present invention is to provide a self-supporting air tube for blasting and method of blasting rock using the air tube that maximally extends the length of explosion of explosive, so that rock is uniformly blasted by increasing total pressure on rock near a free face at the time of explosion, thus decreasing the amount of explosive used for the blasting of rock, and that allows explosive to be loaded in the vicinity of the free face, so that the occurrence of boulders is reduced.

In order to accomplish the above object, the present invention provides a self-supporting air tube for blasting. In accordance with embodiments of the present invention, the air tube includes an air bladder configured to have a diameter smaller than that of a blasting hole and to extend longitudinally; a pair of support wings configured to extend from the outside of the air bladder to the wall of the blasting hole symmetrically with respect to the longitudinal axis of the air bladder so as to surround the air bladder and have certain widths from the lateral surface of the air bladder to the wall of the blasting hole; and an inlet attached to the upper fusion-welded portion of the air bladder to inject air into the air bladder, wherein the total diameter of the air tube is smaller than the diameter of the blasting hole, and the air tube is inserted into the blasting hole and self-supported on a wall of the blasting hole.

In accordance with embodiments of the present invention, the width of each support wing is identical to the diameter of the air bladder.

In accordance with embodiments of the present invention, the support wings are formed by fusion-welding two synthetic resin films in plate form.

In accordance with embodiments of the present invention, the support wings are provided with longitudinal bending lines at regular intervals while the support wings are formed by fusion-welding two synthetic resin films.

In accordance with embodiments of the present invention, the air tube further includes one or more hook holes that are formed in a lower fusion-welded portion below the air bladder and from which weight pockets can be suspended.

In accordance with embodiments of the present invention, the hook holes are formed in a center portion of the lower fusion-welded portion below the air bladder.

In accordance with embodiments of the present invention, the hook holes are symmetrically formed in the lower fusion-welded portion below the air bladder.

In accordance with embodiments of the present invention, a lower fusion-welded portion formed below the air bladder is extended to have a certain height and a weight pocket is formed in a center portion of the lower fusion-welded portion.

In accordance with embodiments of the present invention, openings are formed in center portions of right and left fusion-welded portions of the support wings and weight pockets are formed between the openings and a lower fusion-welded portion.

In accordance with embodiments of the present invention, openings are formed in upper end portions of right and left fusion-welded portions of the support wings and weight pockets are formed between the openings and a lower fusion-welded portion.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
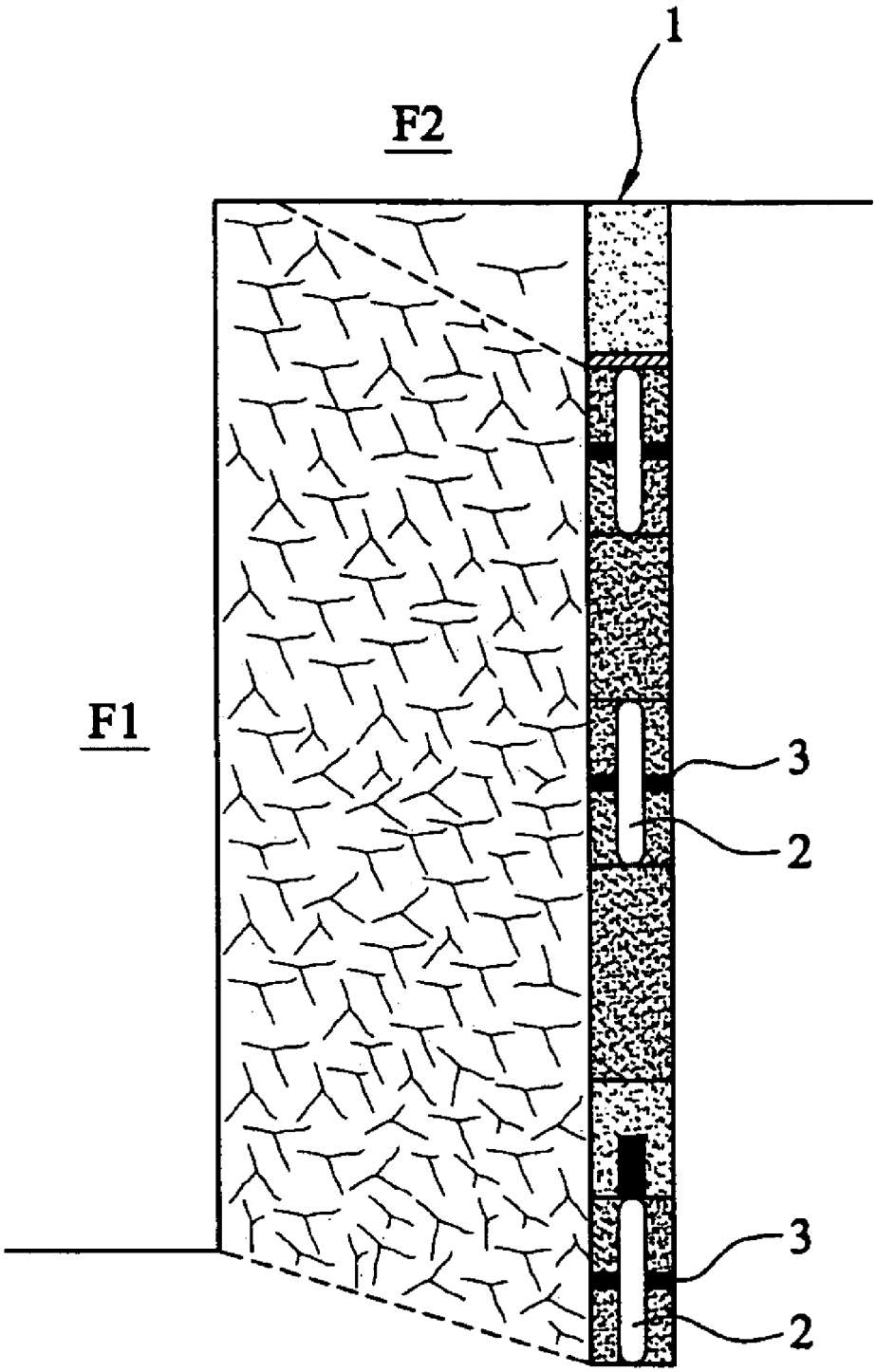
FIG. 1 is a sectional view showing a method of blasting rock using conventional air tubes.
Figure 2:
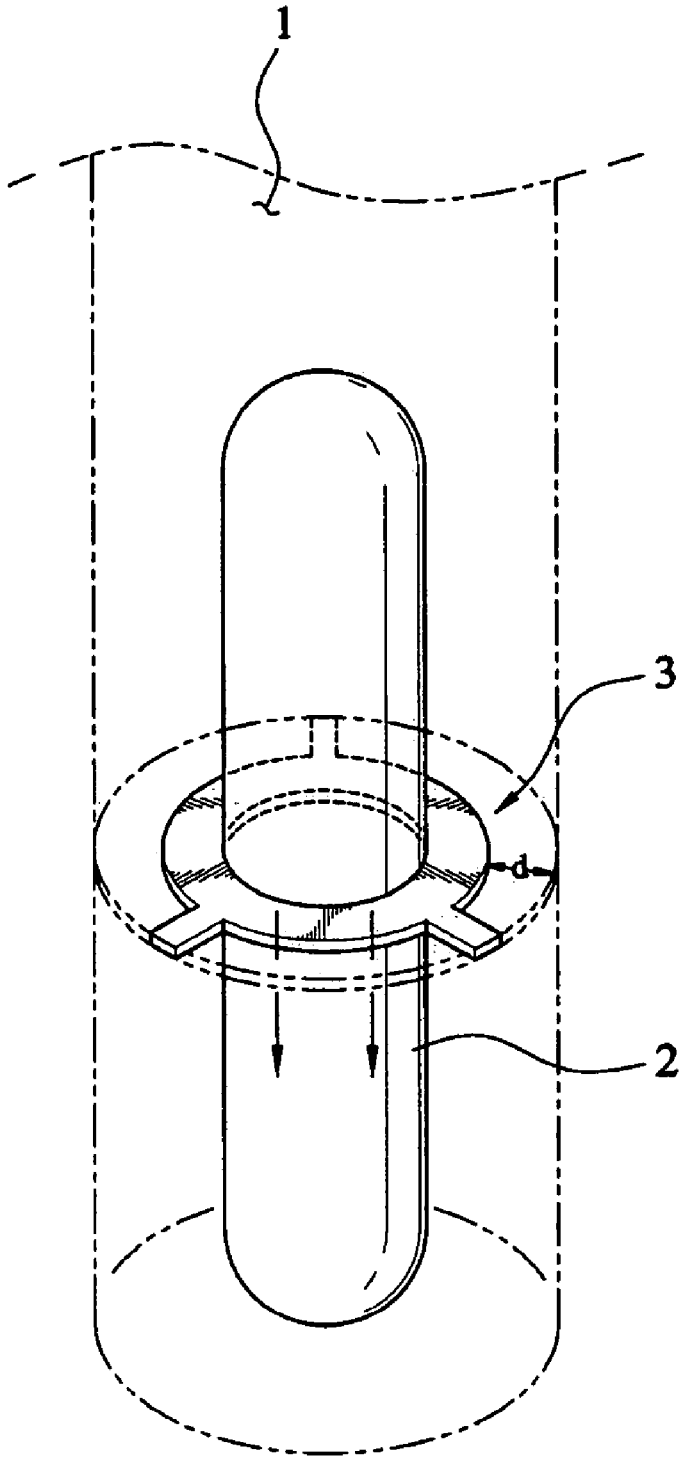
FIG. 2 is a schematic diagram showing a conventional air tube that is mounted into a support frame, inserted into a blasting hole and supported on the wall of the blasting hole.

Reference should now be made to the drawings, in which the same reference numerals are used throughout the different drawings to designate the same or similar components.

Figure 3:
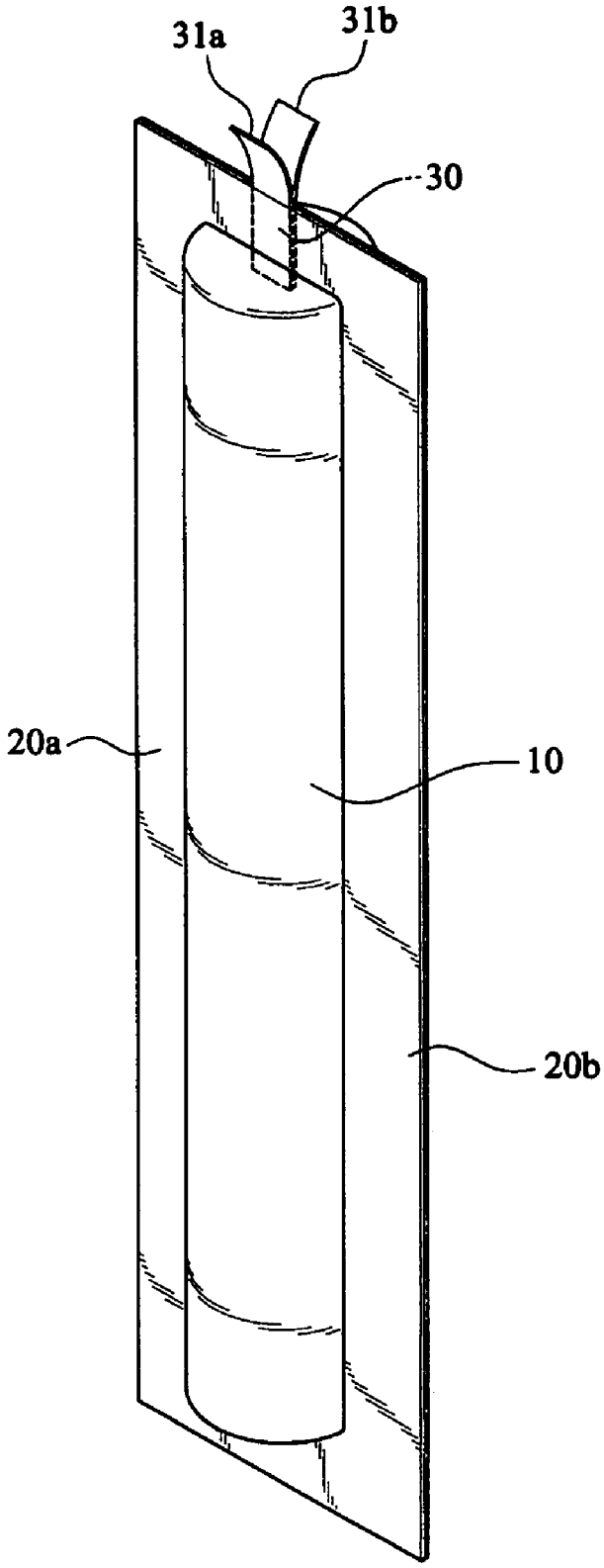
FIG. 3 is a perspective view showing a self-supporting type air tube for blasting in accordance with a first embodiment of the present invention.
Figure 4:
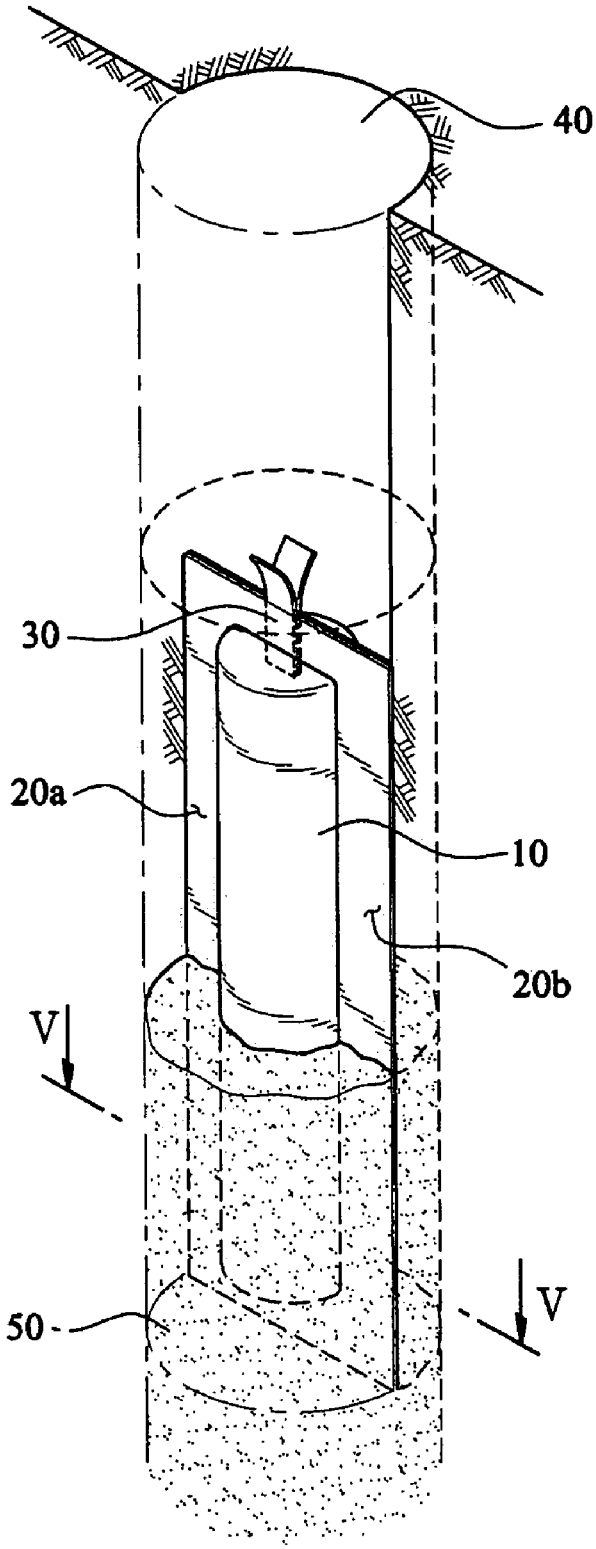
FIG. 4 is a partially exploded perspective view showing the self-supporting type air tube for blasting, in accordance with the present invention, which is inserted into a blasting hole.
Figure 5:
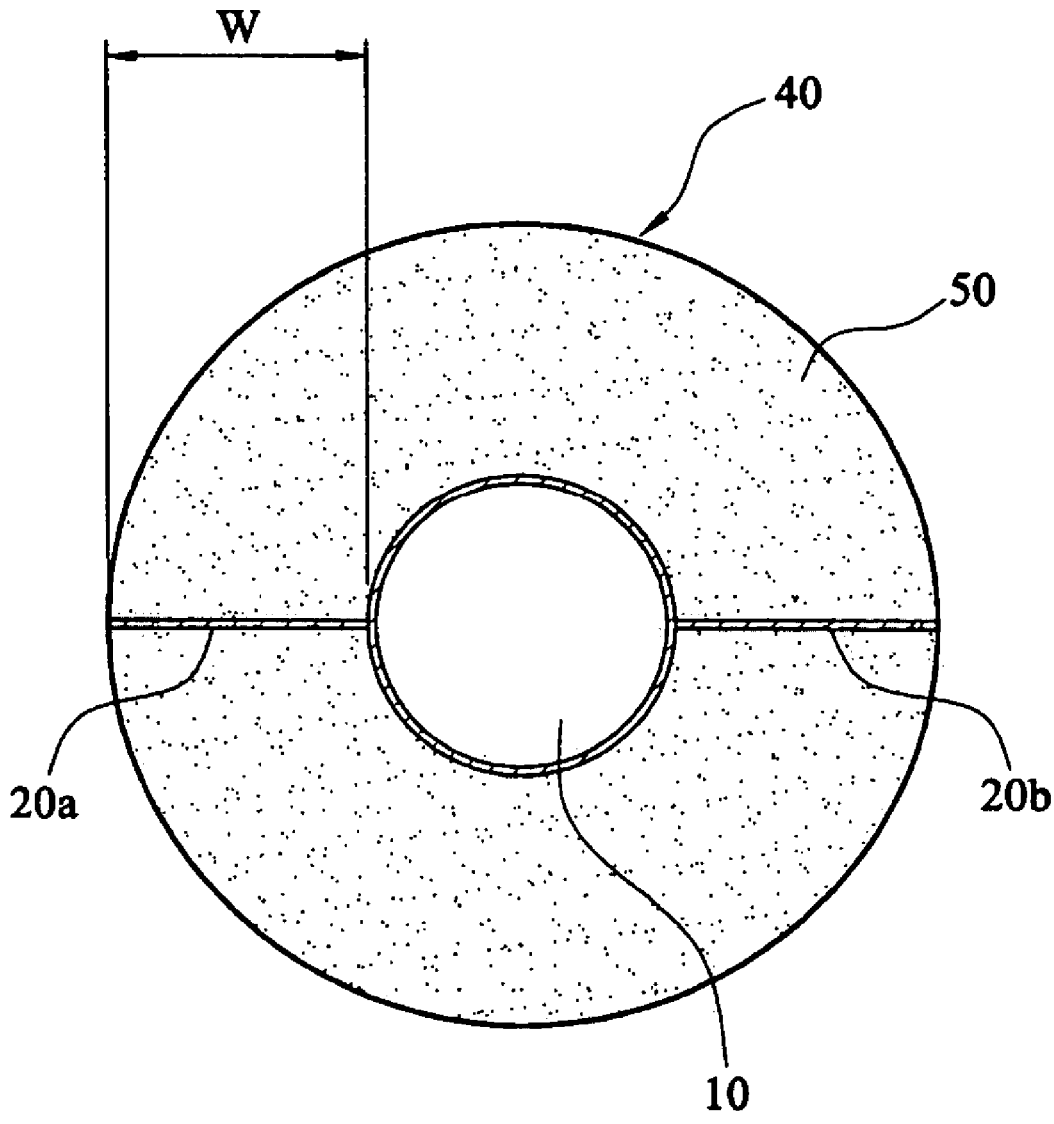
FIG. 5 is a sectional view taken along line V-V of FIG. 4.

FIG. 3 is a perspective view showing a self-supporting type air tube for blasting in accordance with a first embodiment of the present invention. FIG. 4 is a partially exploded perspective view showing the self-supporting type air tube for blasting, in accordance with the present invention, which is inserted into a blasting hole. FIG. 5 is a sectional view taken along line V-V of FIG. 4.

As shown in the drawings, the self-supporting air tube for blasting includes an air bladder 10 that has a diameter smaller than that of the blasting hole and extends longitudinally, two or more support wings 20*a* and 20*b* that symmetrically projects from the outside of the air bladder 10 to have a width from the lateral surface of the air bladder 10 to the wall of the blasting hole 40 and fusion-welded to the air bladder 10 along the length of the air bladder 10, and an inlet 30 that is attached to the upper end of the air bladder 10 to allow air to be injected therethrough into the air bladder 10.

In the self-supporting air tube for blasting in accordance with the present invention, the air bladder 10 is formed by fusion-welding the upper, lower and side portions of overlapped upper and lower rectangular-shaped synthetic resin sheets to each other at the center portion of the self-supporting air tube. That is, the air bladder 10 that is formed at the center portion of the self-supporting air tube and a peripheral fusion-welded portion that extends from the outside of the air bladder 10 to the wall of the blasting hole 40 to surround the air bladder 10 are integrated with each other into a single body.

In that case, the two side fusion-welded portions of the peripheral fusion-welded portion are formed to each have a sufficient width, that is, a width identical to a distance from the lateral surface of the air bladder 10 to the wall of the blasting hole 40, and constitute the right and left support wings 20*a* and 20*b*. The reason for forming the right and left support wings 20*a* and 20*b* is to position the air bladder 10 in the center portion of the blasting hole while spacing the air bladder 10 apart from the wall of the blasting hole 40 by the width W of each support wing 20*a* or 20*b* at the time of inserting the air tube into the blasting hole 40.

Since air is not inserted into the air bladder 10 when the two synthetic resin sheets are fusion-welded to each other, the inlet 30 must be attached to the air bladder 10 to allow air to be injected into the air bladder 10 after fusion welding.

In order to form the inlet 30, two synthetic resin patches 31*a* and 31*b*, which are each longer than the upper fusion-welded portion, are placed on the upper fusion-welded portion of the air bladder 10 and overlap each other, and the two patches 31*a* and 31*b* are fusion-welded to each other such that they project into the interior of the air bladder 10 and the outside of the upper fusion-welded portion through the upper fusion-welded portion. In accordance with embodiments of the present invention, the inlet 30 may comprise a valve structure described in U.S. Pat. No. 4,674,532, the contents of which are incorporated herein by reference in its entirety.

The inside of the air bladder 10 is made to communicate with the outside of the air bladder 10 through the inlet 30 in such a way as to prevent the portion of the air bladder 10, on which the patches 31*a* and 31*b* are placed, from being fusion-welded to each other by forming the patches 31*a* and 31*b* using material having a high melting point at the time of forming the upper fusion-welded portion of the air tube.

Furthermore, the two patches 31*a* and 31*b* project upward from the upper fusion-welded portion of the air bladder 10, so that the inlet 30 is opened by pulling the patches 31*a* and 31*b* with both hands, the noble of an air injection device is inserted into the opened inlet 30 and air is injected into the air bladder 10 through the noble.

As shown in FIGS. 4 and 5, since the self-supporting air tube for blasting in accordance with the present invention is provided with a pair of support wings 20*a* and 20*b* symmetrically with respect to the longitudinal axis of the air bladder 10, the side ends of the right and left support wings 20*a* and 20*b* having a uniform width come into contact with and are supported on the wall of the blasting hole 40 when the air tube is inserted into the blasting hole 40, so that the self-supporting air tube is not inclined and stands upright. As a result, the air bladder 10 spaced apart from the wall of the blasting hole 40 by the width W of each support wing is positioned in the center portion of the blasting hole 40.

Accordingly, the air tube injected with air can be inserted into and used in the blasting hole 40 while standing upright without the need to use a support frame to stand the air tube as in the preceding Korean Pat. 10-2001-54369 (corresponding to U.S. Pat. No. 6,631,684).

In addition, in the self-supporting air tube for blasting in accordance with the present invention, the support wings 20*a* and 20*b* are formed on the right and left sides of the air tube, so that explosive 50 loaded into the blasting hole 40 are separated in a horizontal direction, not in a vertical direction. Accordingly, the explosive 50 is continuously loaded in the vertical direction, so that simultaneous detonation can occur within the length of the blasting hole 40.

In the meantime, when the blasting hole 40 is drilled into rock to blast the rock, the diameter of a first drilled blasting hole may differ from the diameter of a last drilled blasting hole due to a bit gage drop phenomenon.

In the case of a blasting hole having a small diameter, the width of the air tube is larger than that of the blasting hole, so that frictional resistance occurs when the air tube is inserted into the blasting hole having a small diameter and, therefore, it becomes difficult to insert the air tube into the blasting hole.

Accordingly, when two or three bending lines are formed along the length of the support wings so as to insert the air tube into the blasting hole while overcoming the frictional resistance even though the diameter of the blasting hole is small, the total width of the support wings can be adjusted, so that the air tube can be inserted into the blasting hole while conforming to the wall of the blasting hole.

Figure 6:
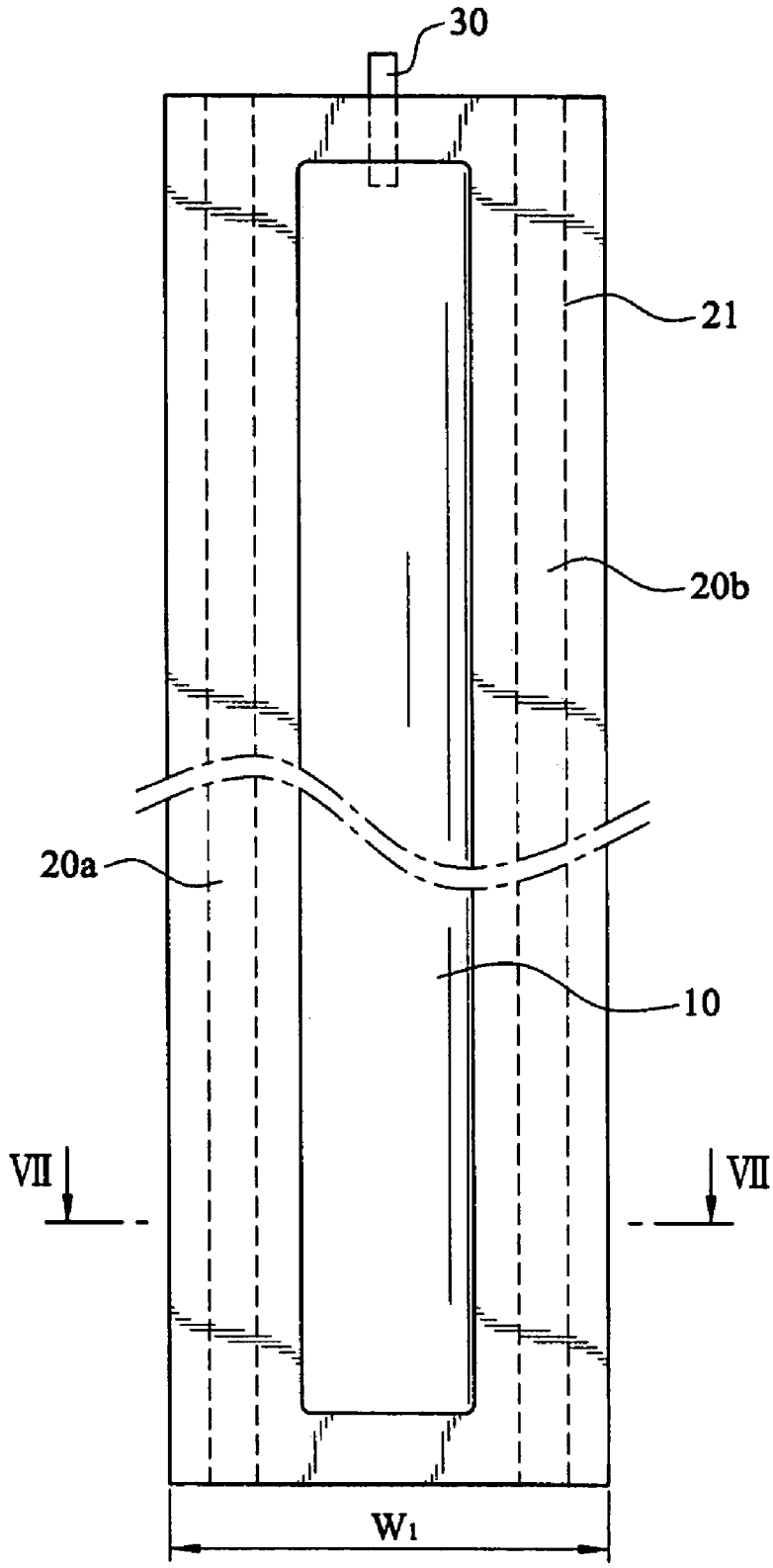
FIG. 6 is a view showing a self-supporting air tube for blasting with bending lines formed on support wings in accordance with a second embodiment of the present invention.
Figure 7:
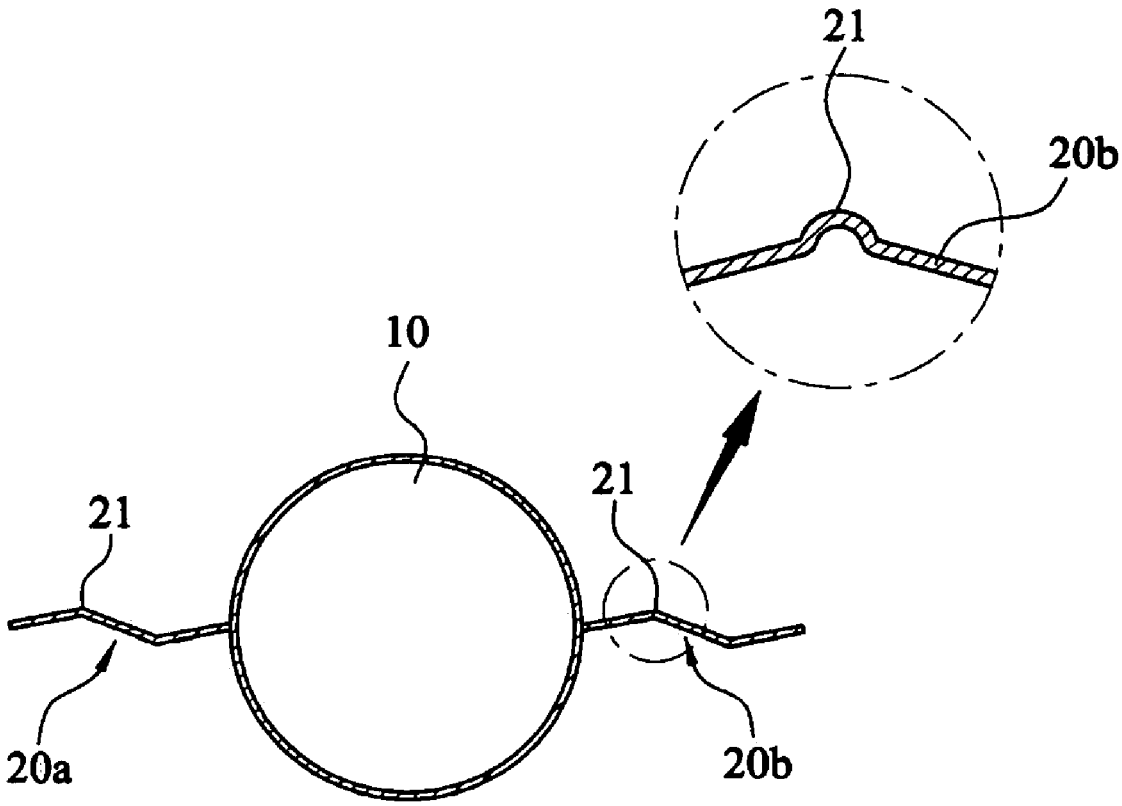
FIG. 7 is a sectional view taken along line VII-VII of FIG. 6.
Figure 8:
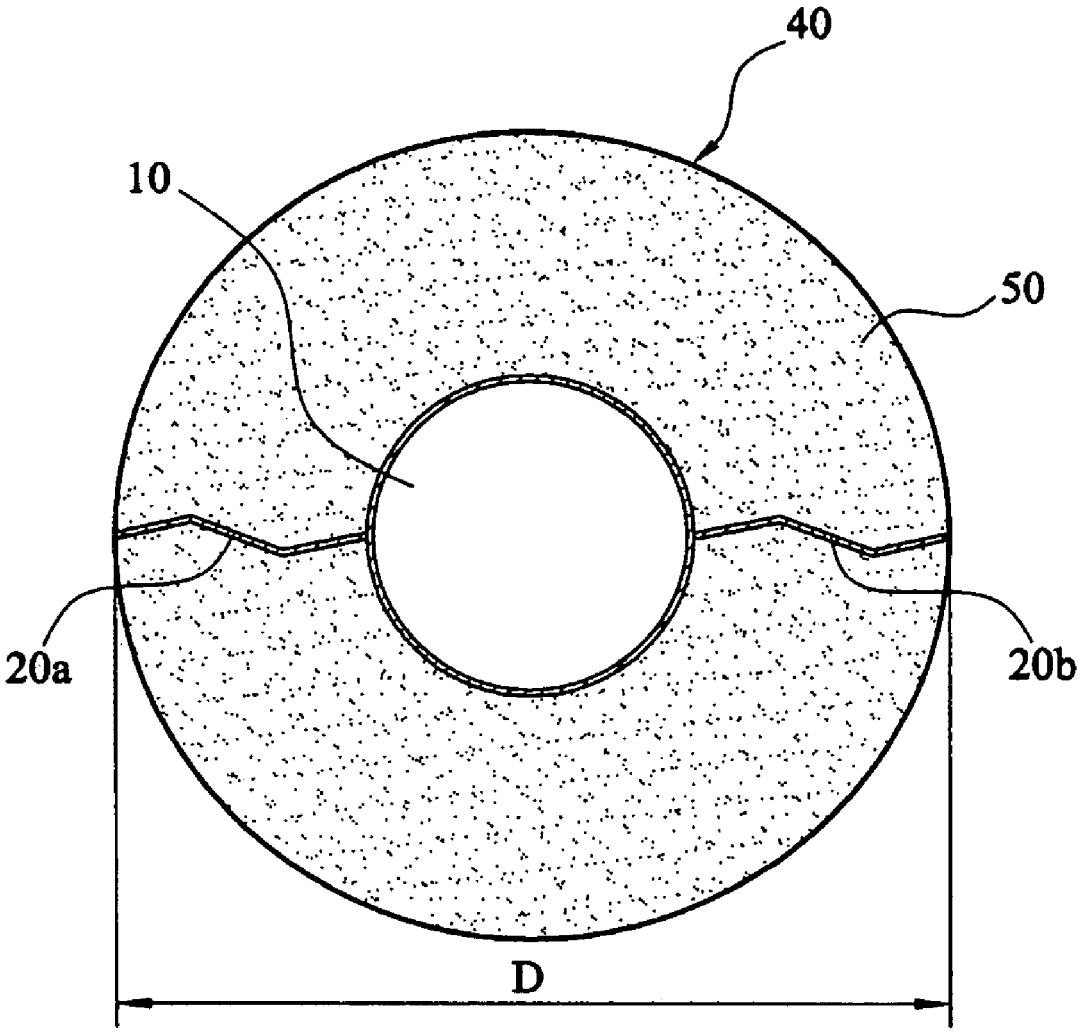
FIG. 8 is a sectional view showing the self-supporting air tube of FIG. 6, according to the second embodiment, which is inserted into a blasting hole.

FIG. 6 is a view showing a self-supporting air tube for blasting with bending lines formed on support wings in accordance with a second embodiment of the present invention. FIG. 7 is a sectional view taken along line VII-VII of FIG. 6. FIG. 8 is a sectional view showing the self-supporting air tube of FIG. 6, according to the second embodiment, which is inserted into a blasting hole.

In the self-supporting air tube according to the present embodiment, two or three bending lines are longitudinally formed along the center portion of each support ring 20*a* or 20*b*. The right and left support rings 20*a* and 20*b* can be easily bent along the bending lines.

Accordingly, as shown in FIGS. 6 to 8, when the air tube with the bending lines 21 formed on right and left support wings 20*a* and 20*b* is inserted into the blasting hole 40 having a small diameter, the right and left support wings 20*a* and 20*b* are bent along the bending lines 21 and, therefore, the widths of the support wings 20*a* and 20*b* are decreased even though the diameter D of the blasting hole 40 is smaller than the total width of the air tube (that is, the width ranging from the left end of the support wing 20*a* to the right end of the support wing 20*b*), so that the air tube can be inserted into the blasting hole 40 without high resistance.

Figure 9:
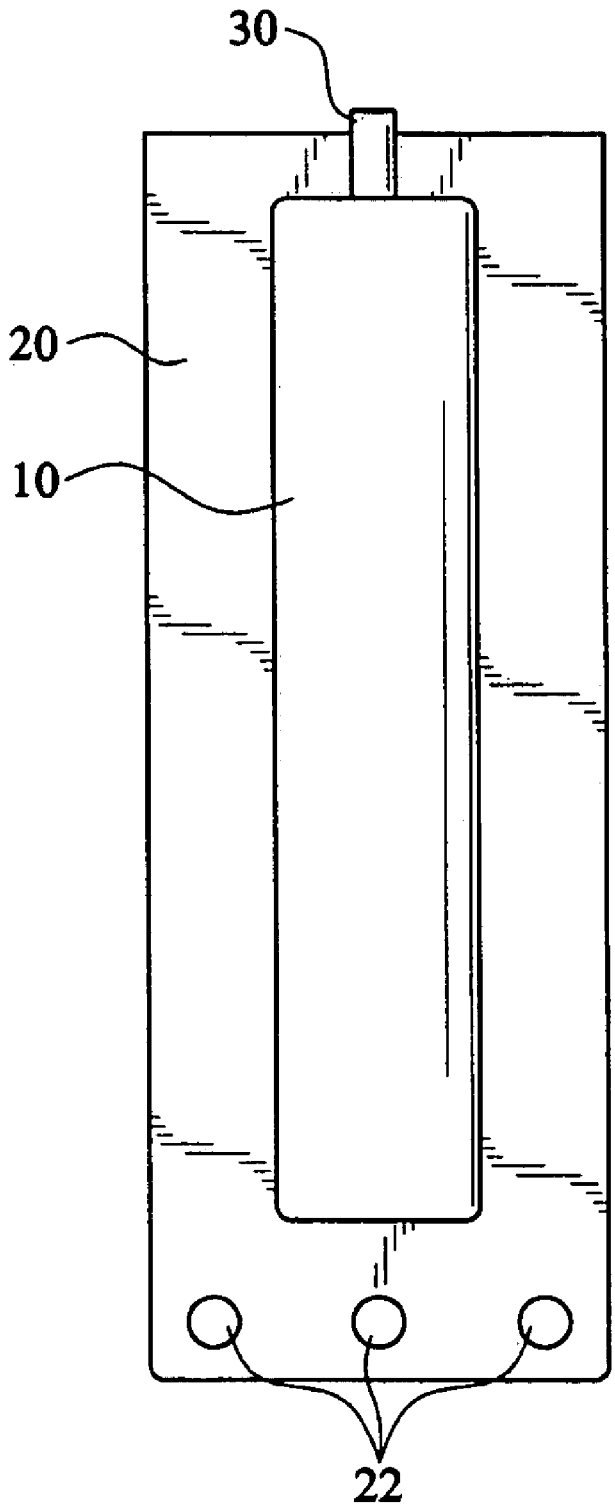
FIG. 9 is a view showing a self-supporting air tube for blasting with hook holes formed through the lower fusion-welded portion of the self-supporting air tube in accordance with a third embodiment of the present invention.

FIG. 9 is a view showing a self-supporting air tube for blasting with hook holes formed through the lower fusion-welded portion of the self-supporting air tube in accordance with a third embodiment of the present invention.

The present embodiment is an embodiment in which, in the case where the diameter D of a blasting hole 40 is smaller than the total width W1 of an air tube and, therefore, inserted support wings 20*a* and 20*b* come into contact with the wall of the blasting hole 40 and have high frictional resistance in spite of the adjusting action of the support wings 20*a* and 20*b* having bending lines 21, the center of gravity of the air tube is positioned at the lower part of the air tube by forming hook holes 22, from which weights are suspended, through the lower fusion-welded portion of the air tube and suspending weights from the hook holes 22, as shown in FIG. 9, so as to overcome frictional resistance, thus increasing the falling force of the air tube in the blasting hole.

Meanwhile, in the present embodiment, one hook hole 22 may be formed at the center of the lower fusion-welded portion to suspend a weight from the hook hole 22, or a pair of hook holes 22 may be formed through the lower fusion-welded portion of the air tube symmetrically with respect to the transverse axis of the lower fusion-welded portion. When the hook holes 22 are formed, the weight of the air tube can be adjusted and, therefore, the downward insertion of the air tube is facilitated even though the frictional resistance between the air tube and the wall of the blasting hole 40 is high, compared to the case where a single hook hole is formed.

Figure 10:
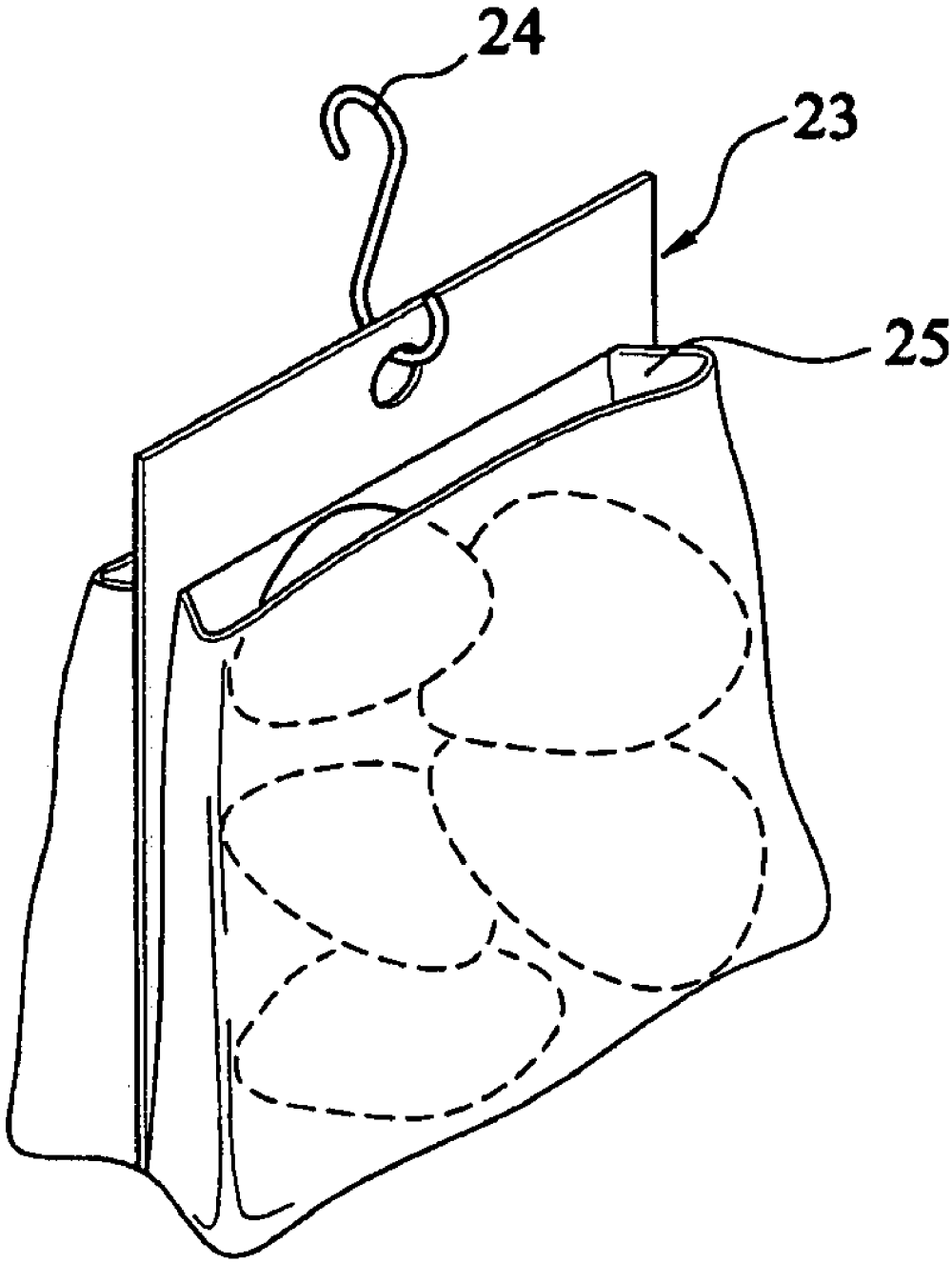
FIG. 10 is a perspective view showing a weight pocket that is suspended from the hook hole of the self-supporting air tube according to the present invention.

FIG. 10 is a perspective view showing a weight pocket that is suspended from the hook hole of the self-supporting air tube according to the present invention.

As shown in FIG. 10, a weight pocket 23 suspended from the hook hole 22 is formed of a synthetic resin bag that can be easily acquired. A weight is formed of rock fragments, sand or soil that can be acquired at a blasting site. The rock fragments, sand or soil is put into the weight pocket 23 through an opening 25.

A hook 24 used to suspend the weight pocket 23 from the hook hole 22 is made of plastic or steel wire in an S shape. A previously made hook may be used as the hook hole 22, or the hook hole 22 may be connected to the weight pocket 23 using a cord (not shown) at a blasting site. A connection means having one of various forms may be used as the hook 24.

Figure 11:
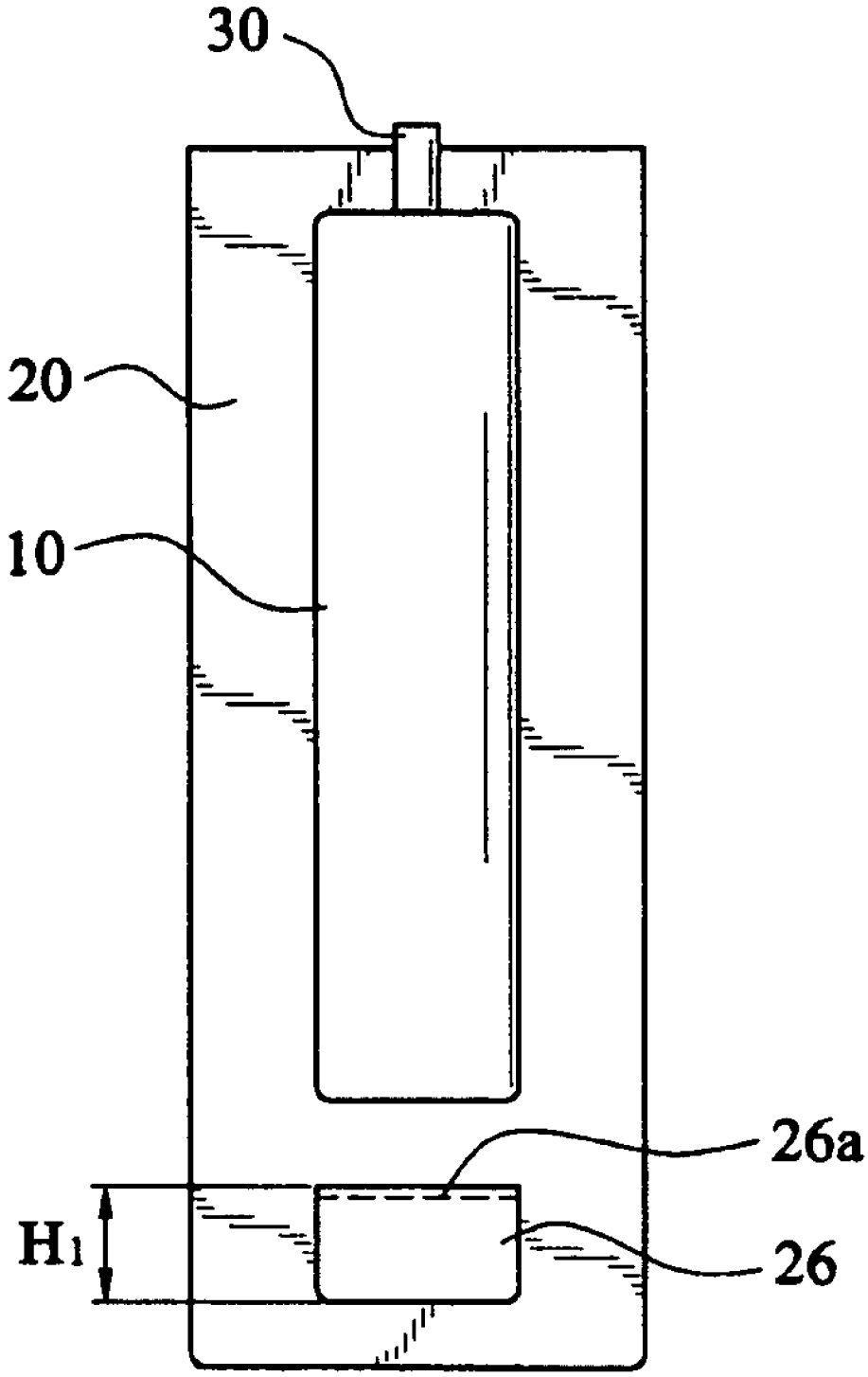
FIG. 11 is a view showing a self-supporting air tube provided with a weight pocket at the lower portion thereof in accordance with a fourth embodiment of the present invention.
Figure 12:
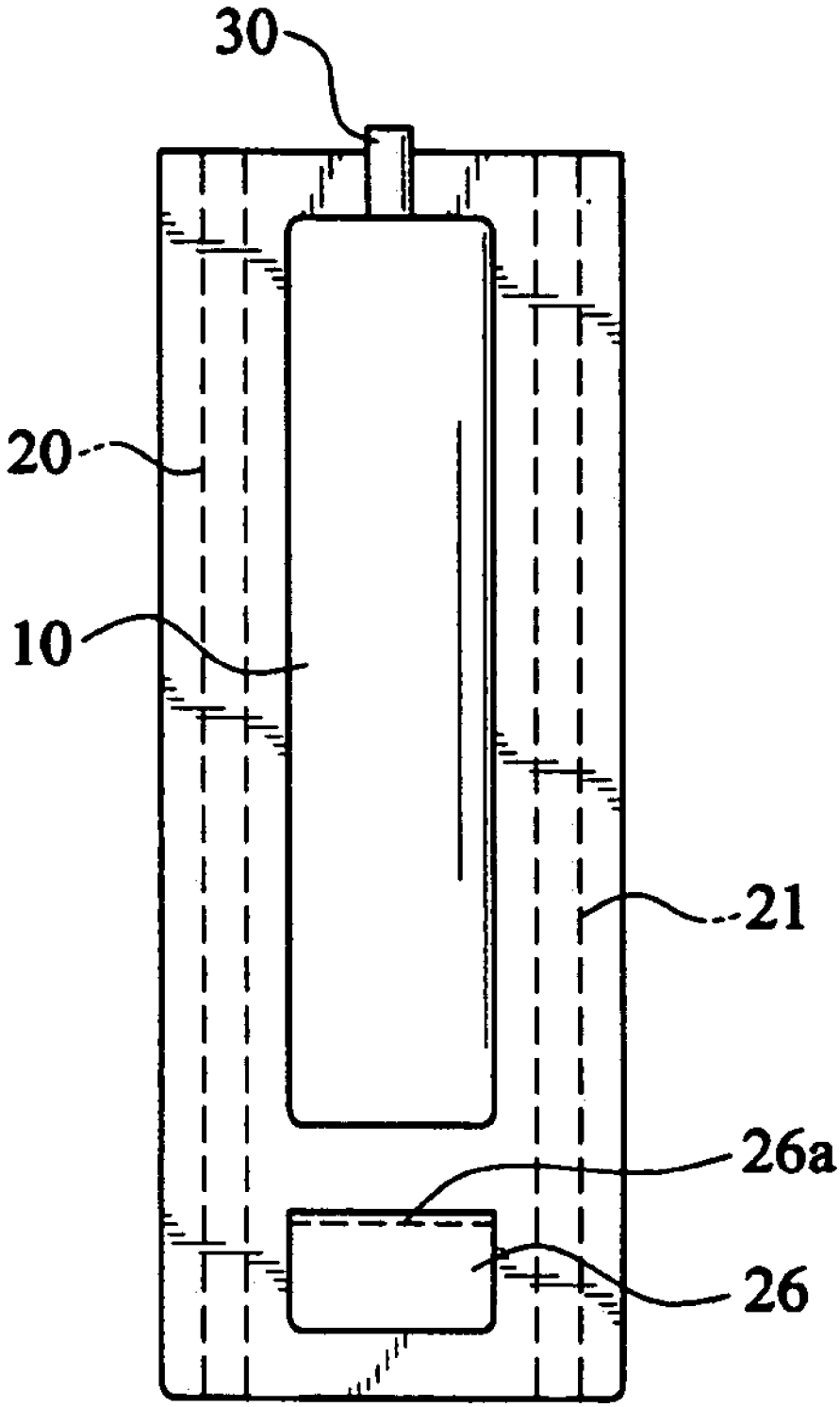
FIG. 12 is a view showing a self-supporting air tube provided with bending lines, and a weight pocket at the lower portion thereof, in accordance with a fifth embodiment of the present invention.

FIG. 11 is a view showing a self-supporting air tube provided with a weight pocket at the lower portion thereof in accordance with a fourth embodiment of the present invention. FIG. 12 is a view showing a self-supporting air tube provided with bending lines, and a weight pocket at the lower portion thereof in accordance with a fifth embodiment of the present invention.

In the present embodiments, instead of the use of the separate synthetic resin bag, weight pockets 26 are inserted into the lower portions of the air tubes, respectively, so that the air tubes being inserted into blasting holes can overcome the frictional resistance between the walls of the blasting holes and the air tubes in the case where it is not easy to insert the air tubes into the blasting holes due to the contact of the right and left support wings 20*a* and 20*b* with the walls of the blasting holes.

Each of the weight pockets 26 is formed using two sheets having different melting points in consideration of the height $H_1$ of the weight pocket 26 while preventing the portions of the weight pocket 26 from becoming attached to each other at the time of forming the air tube. An opening 26*a* is formed by cutting the upper end of the weight pocket 26, so that the center of gravity of the air tube is positioned at the lower portion of the air tube by putting rock fragments, sand or soil into the weight pocket 26, thus allowing the air tube to be easily inserted into the blasting hole 40 while overcoming frictional resistance even though right and left support wings 20*a* and 20*b* come into contact with the wall of the blasting hole 40.

Figure 13:
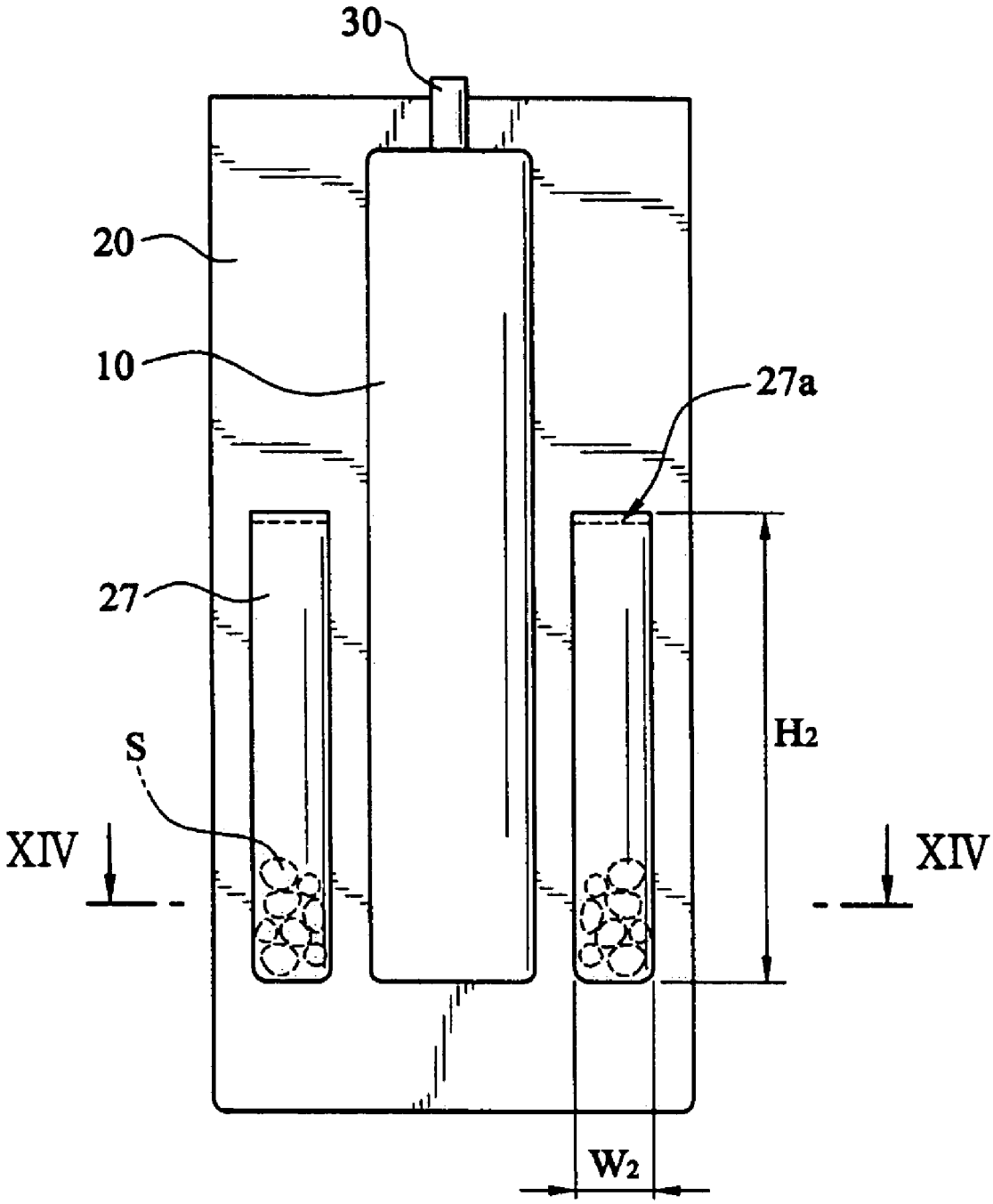
FIG. 13 is a view showing an air tube provided with weight pockets that are formed between the centers and lower ends of support wings in accordance with a sixth embodiment of the present invention.
Figure 14:
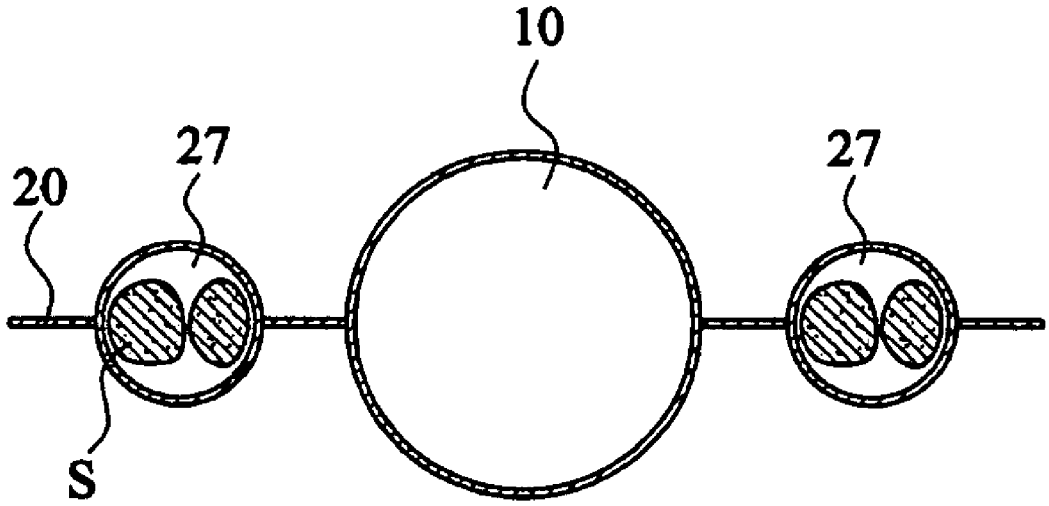
FIG. 14 is a sectional view taken along line XIV-XIV of FIG. 13.

FIG. 13 is a view showing an air tube provided with weight pockets that are formed between the centers and lower ends of support wings in accordance with a sixth embodiment of the present invention. FIG. 14 is a sectional view taken along line XIV-XIV of FIG. 13.

The present embodiment is constructed in such a way that weight pockets are formed between the centers and lower ends of the support wings of the air tube and weights are put into the weight pockets. In the present embodiment, two weight pockets 27 are formed in the support wings 20*a* and 20*b* symmetrically with respect to the longitudinal axis of the air tube 10, and openings 27*a* are formed at the upper ends of the weight pockets 27, so that rock fragments S are accommodated in the weight pockets 27 through the openings 27*a*.

The weight pockets 27 can be formed in the right and left support wings 20*a* and 20*b* by fusion-welding two or more synthetic resin films having different melting points in consideration of the height $H_2$ and width $W_2$ of the weight pockets 27.

After the weight pockets 27 have been formed, the center of gravity of the air tube is positioned at the lower portion of the air tube by cutting the upper ends of the weight pockets 27 and putting rock fragments into the weight pockets 27, and the openings 27*a* may be sealed using adhesive tape.

Figure 15:
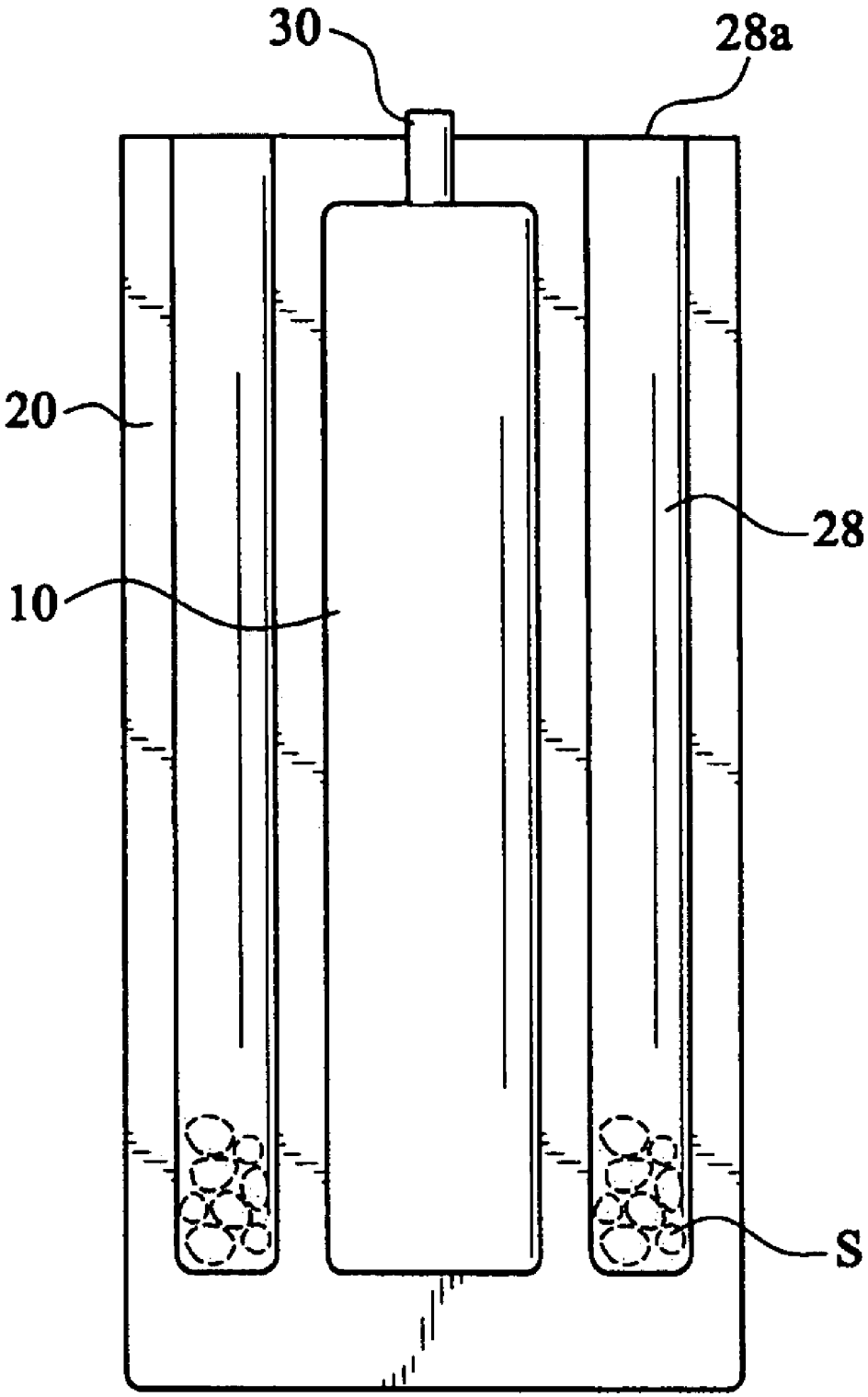
FIG. 15 is a view showing a self-supporting air tube provided with weight pockets that are formed between the upper and lower ends of support wings in accordance with a seventh embodiment of the present invention.

FIG. 15 is a view showing a self-supporting air tube provided with weight pockets that are formed between the upper and lower ends of support wings in accordance with a seventh embodiment of the present invention.

In the present embodiment, weight pockets 28 are formed in right and left support wings 20*a* and 20*b* to be longer than an air bladder 10 while preventing the upper ends of the weight pockets 28 from being fusion-welded to each other, and rock fragments are put into the weight pockets 28 through openings 28*a*, thus allowing the center of gravity of the air tube to be positioned at the lower portion of the air tube.

The weight pockets 28 are flexible, like the support wings having the bending lines, so that the weight pockets 28 are bent or the width of the weight pockets 28 is reduced due to the flexibility thereof in the case where the width of the air tube is larger than the diameter of a blasting hole and, therefore, resistance occurs, thus inserting the air tube into the blasting hole without high resistance. The openings 28*a* of the weight pockets 28 can be sealed using adhesive tape.

Figure 16:
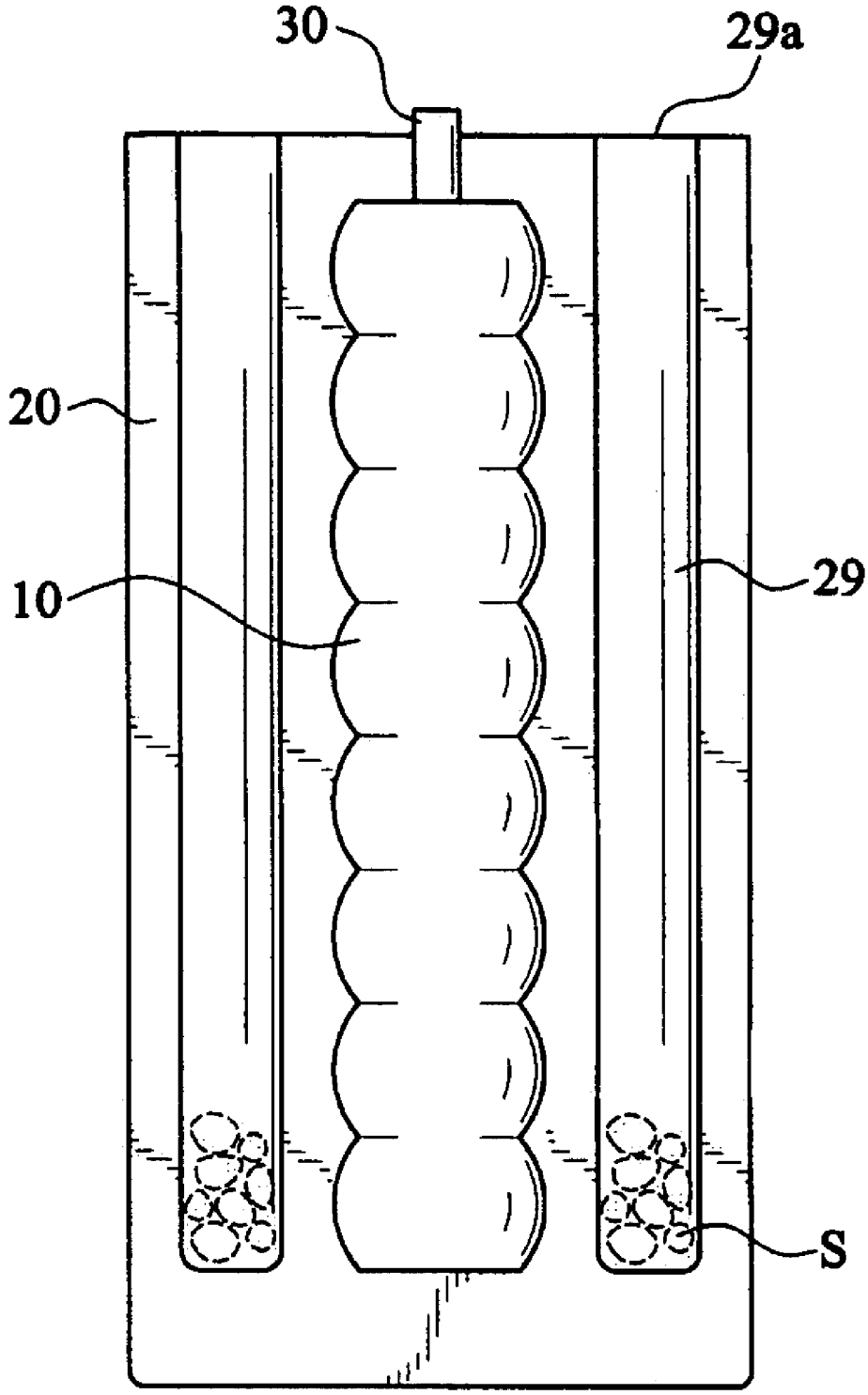
FIG. 16 is a view showing a self-supporting air tube provided with a bellows type air bladder, and weight pockets in support wings.

FIG. 16 is a view showing a self-supporting air tube provided with a bellows type air bladder, and weight pockets in support wings.

As shown in FIG. 16, in the present embodiment, the diameter of an air bladder 10 alternately increases and decreases along the length of the air bladder 10, weight pockets 29 are formed in right and left support wings 20, and rock fragments S are put into the weight pockets 29, thus positioning the center of gravity at the lower portion of the air tube.

Since the air tube of the present embodiment has a diameter that alternately increases and decreases at regular intervals, the air tube has flexibility in a transverse direction, so that the air tube can be bent and pushed by a transverse force. The openings 29*a* of the weight pockets 29 may be sealed using adhesive tape.

Figure 17:
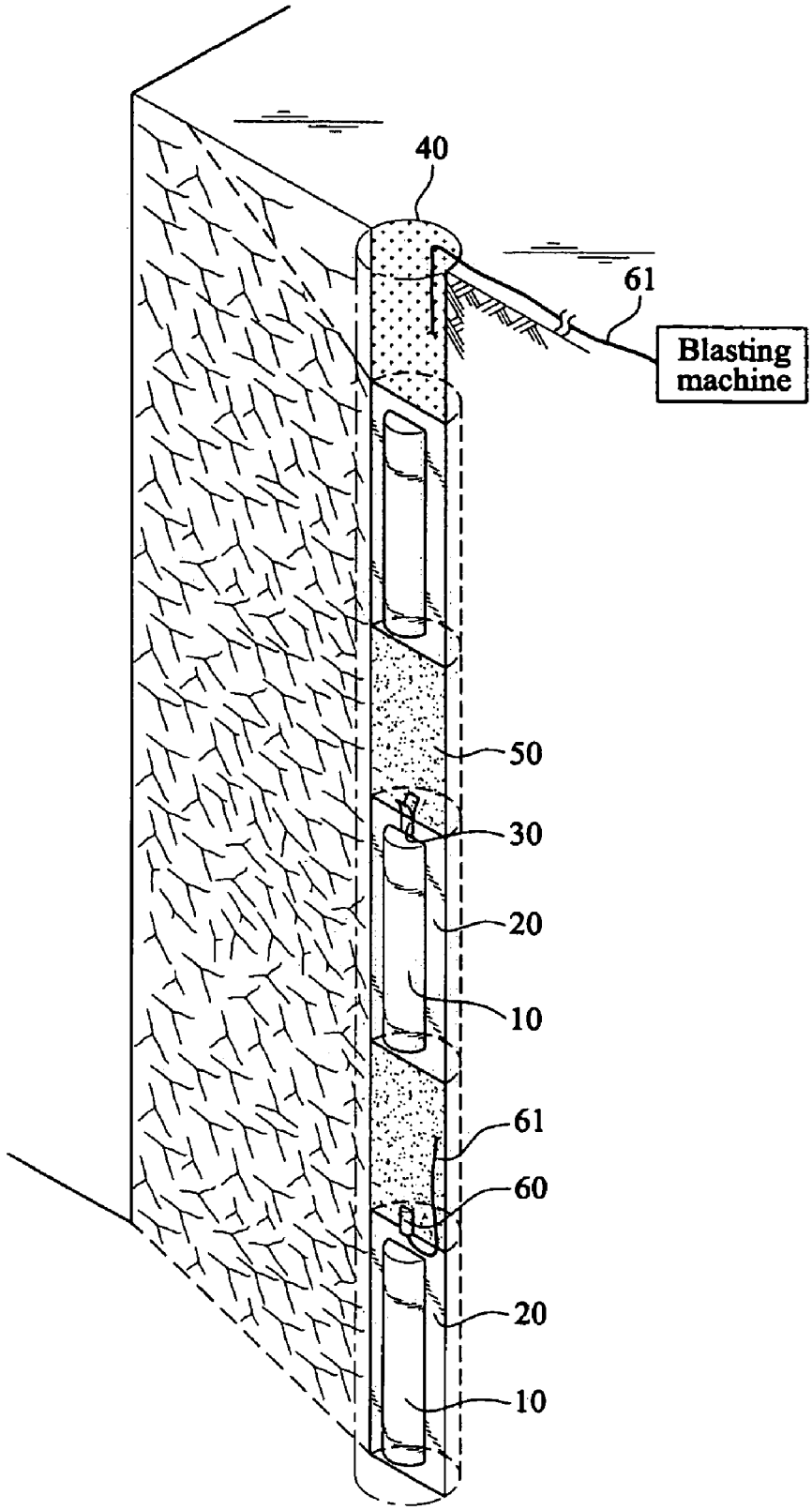
FIG. 17 is a perspective view showing a method of blasting rock using the self-supporting air tube in accordance with the present invention.
Figure 18:
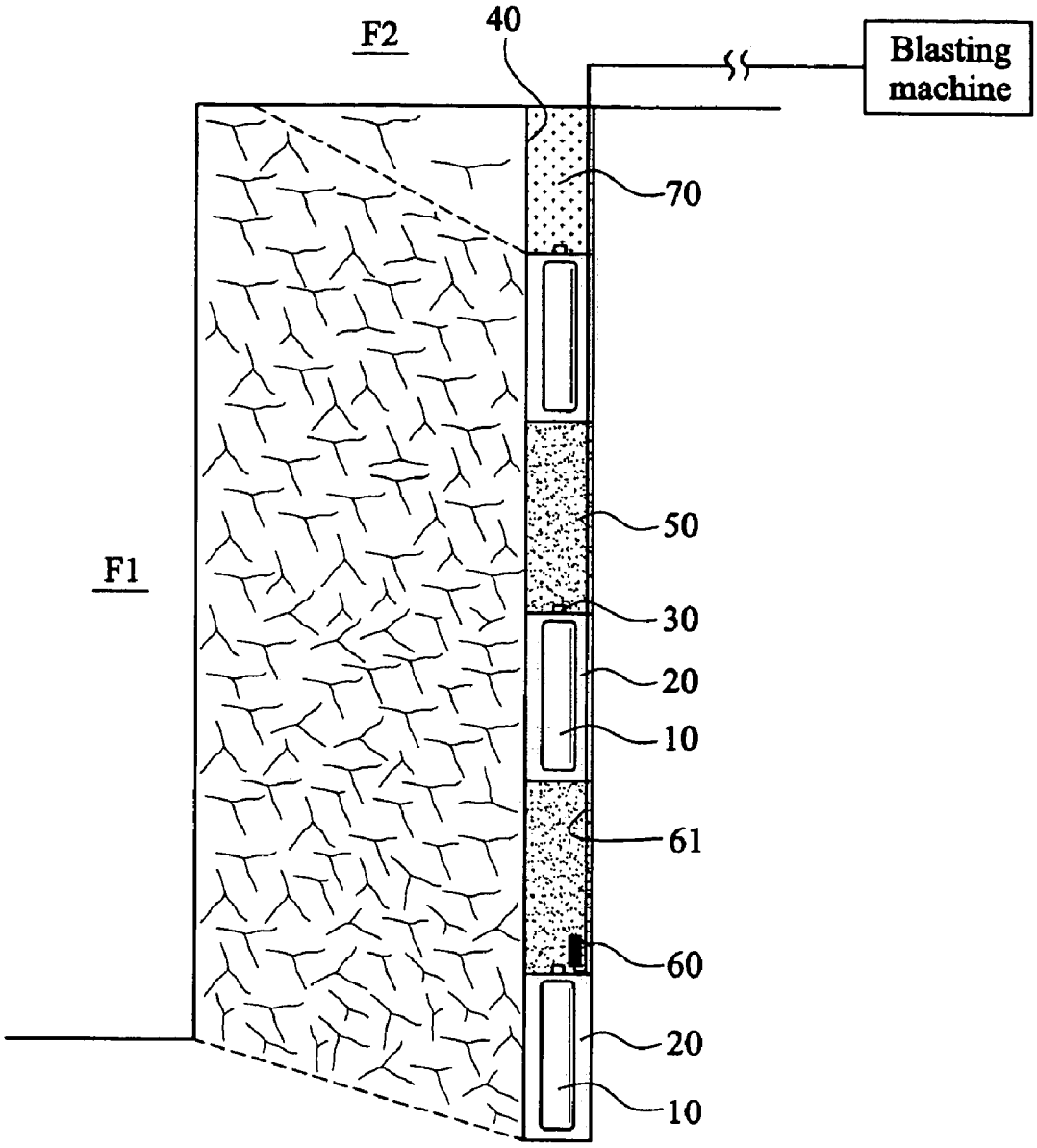
FIG. 18 is a longitudinal section of FIG. 17.

A method of blasting rock using the self-supporting air tube according to the present invention is described with reference to FIGS. 17 and 18.

The method of blasting rock using the self-supporting air tube includes:

the step of drilling one or more blasting holes into rock to have certain depths and arrangement;

the step of loading one or more self-supporting air tubes, each of which includes an air bladder smaller in diameter than each blasting hole and filled with air, a pair of support wings projecting outward from the outside of the air bladder to the wall of the blasting hole and one or more weight pockets formed below or in lower portions of the support wings, in a center portion of each blasting hole;

the step of loading explosive and a detonator to surround the self-supporting air tubes inserted into the blasting holes;

the step of stemming entrances of the blasting holes into which the explosive is loaded; and the step of detonating the detonator using a blasting machine to explode the explosive loaded into the blasting holes.

Furthermore, the step of loading the air tubes into the blasting holes is performed in such a way that one or more weight pockets are connected to one or more hook holes, which are formed in lower ends of the support wings, of each air tube using one or more cords or hooks and, then, the air tube is loaded into the blasting hole.

Furthermore, the step of loading the air tubes into the blasting holes is performed in such a way that rock fragments acquired at a blasting site are put into the weight pockets formed below the support wings or in the lower portions of the support wings and, then, the air tubes are loaded into the blasting holes.

Furthermore, the step of loading the air tubes into the blasting holes is performed in such a way that the rock fragments acquired at the blasting site are put into the weight pockets formed between center portions and lower ends of the support wings and, then, the air tubes are loaded into the blasting holes.

Furthermore, the step of loading the air tubes into the blasting holes is performed in such a way that the rock fragments acquired at the blasting site are put into the weight pockets formed between upper and lower ends of the support wings and, then, the air tubes are loaded into the blasting holes.

Furthermore, the step of loading the air tubes into the blasting holes is performed in such a way that the openings of the weight pockets filled with the rock fragments are sealed using adhesive tape and, then, the air tubes are loaded into the blasting holes.

The method of blasting rock using the self-supporting air tube for blasting according to the present invention is characterized by the steps of loading one or more self-supporting air tubes, each of which is provided with a pair of support wings 20 that symmetrically extend outward from the outside of an air bladder to the wall of the blasting hole, into the center portion of each blasting hole and loading explosive so that the explosive substantially surrounds the air tubes and the air bladders of the air tubes are positioned in the middle of the explosive. The structure of the air tube of the present invention allows the substantially even distribution of explosive around the air bladder, thus assisting in preventing the air tube from bursting because of uneven loading due to explosives and stemming material.

In the case where an air tube is inserted into a blasting hole having a small diameter at the step of inserting the air tube into the blasting hole, the air tube can be easily inserted downward into the blasting hole by using an air tube provided with support wings having bending lines and/or an air tube provided with one or more weight pockets in the lower portions of the support wings.

In the rock blasting method using self-supporting air tube including the step of loading the air tubes into the blasting hole, air bladders are positioned in the center portion of the blasting hole, so that explosive loaded into the blasting hole is uniformly distributed, thus blasting rock while uniformly applying explosive power to rock around the blasting hole. Furthermore, with the weight pockets formed below the air tube or in the lower portions of the air tube, the air tubes are easily and quickly loaded into the blasting hole.

The other steps of loading explosive 50 and a detonator 60 into the blasting hole 40, stemming the entrance of the blasting hole 40 using a stemming material 70, connecting wires, which are connected to the detonator 60, to a blasting machine, and exploding the explosive 50 by detonating the detonator 60 using the blasting machine are the same as those of the conventional blasting method.

Meanwhile, the patterns of loading the self-supporting air tubes into the blasting hole may be the same as those disclosed in preceding Korean Pat. No. 10-0441222 (U.S. Pat. No. 6,631,684) filed by the present inventor.

In the present invention, one or more self-supporting air tubes are inserted into the blasting hole 40, so that artificial free faces formed by the air tubes can be formed perpendicular to a free face F2, and the explosive power of the explosive 50 can be maximally distributed throughout the blasting hole.

The present invention has the following advantages.

First, the present invention allows an air tube having a diameter smaller than that of a blasting hole to stand upright in the blasting hole without using special equipment, so that explosive loaded in the blasting hole can be uniformly distributed throughout the blasting hole, thus uniformly projecting explosive power onto rock and performing an air decking function, such as reducing the amount of used explosive, blasting vibration and blasting noise, and so that the length of loaded explosive can be adjusted up to a free face, thus reducing the occurrence of boulders.

Second, the present invention has economic advantages in that the insertion of the air tube into the blasting hole can be facilitated by utilizing the characteristics of the material of the air tube at the time of manufacturing the air tube without using additional equipment, so that the installation of the air tube is easy and the air tube can be quickly installed in the blasting hole, thus shortening blasting time.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A self-supporting air tube for blasting in a blasting hole, comprising:

an elongated air bladder configured to have a diameter smaller than a diameter of the blasting hole;

a pair of support wings configured to extend from an outside surface of the air bladder to a wall of the blasting hole, the support wings positioned symmetrically with respect to a longitudinal axis of the air bladder, wherein the air bladder is substantially in the center portion of the blasting hole while the support wings are adapted for contacting on the wall of the blasting hole, wherein the air bladder is configured to be spaced from the wall of the blasting hole by a width of the support wings, wherein the width of each support wing is identical to the diameter of the air bladder; and an inlet attached to an upper fusion-welded portion of the air bladder to inject air into the air bladder, wherein, when the air bladder is inflated, a total diameter of the air tube is smaller than the diameter of the blasting hole, and wherein the air tube is configured to be inserted into the blasting hole and self-supported on the wall of the blasting hole.

2. A self-supporting air tube for blasting within a blasting hole having a wall, the air tube comprising:

an air bladder having a diameter smaller than a diameter of the blasting hole;

a plurality of support wings configured to extend lateral sides of the air bladder, wherein the plurality of support wings are configured to extend laterally, wherein at least one support wing is configured to at least partially contact the wall of the blasting hole and position the air tube in substantially a center portion of the blasting hole by a space of a width of a support wing; wherein the width of the support wing is identical to the diameter of the air bladder; and an inlet attached to the air bladder to allow the injection of air into the air bladder, wherein the air tube is configured to be inserted into the blasting hole and self-supported on the wall of the blasting hole.

3. The air tube as set forth in claim 2, wherein the plurality of support wings comprises two wings located on substantially opposite sides of the air bladder.

4. A self-supporting air tube for blasting in a blasting hole, comprising:

an elongated air bladder configured to have a diameter smaller than a diameter of the blasting hole;

a pair of support wings configured to extend from an outside surface of the air bladder to a wall of the blasting hole, the support wings positioned symmetrically with respect to a longitudinal axis of the air bladder, wherein the air bladder is substantially in the center portion of the blasting hole while the support wings are adapted for contacting on the wall of the blasting hole, wherein the air bladder is configured to be spaced from the wall of the blasting hole by a width of the support wings wherein the width of each support wing is identical to the diameter of the air bladder; and an inlet attached to an upper fusion-welded portion of the air bladder to inject air into the air bladder, wherein, when the air bladder is inflated, a total diameter of the air tube is smaller than the diameter of the blasting hole, and wherein the air tube is configured to be inserted into the blasting hole and self-supported on the wall of the blasting hole.

5. The air tube as set forth in claim 4, wherein the support wings are formed by fusion-welding two synthetic resin films in plate form.

* * * * *